US009944495B2

(12) United States Patent
Webber

(10) Patent No.: US 9,944,495 B2
(45) Date of Patent: Apr. 17, 2018

(54) PORTABLE LIFT

(71) Applicant: Gray Andrew Webber, Ontaongon, MI (US)

(72) Inventor: Gray Andrew Webber, Ontaongon, MI (US)

( * ) Notice: Subject to any disclaimer, the term of this patent is extended or adjusted under 35 U.S.C. 154(b) by 156 days.

(21) Appl. No.: 14/886,861

(22) Filed: Oct. 19, 2015

(65) Prior Publication Data

US 2017/0107082 A1 Apr. 20, 2017

(51) Int. Cl.
*B66B 9/193* (2006.01)
*B66B 9/16* (2006.01)

(52) U.S. Cl.
CPC ..... *B66B 9/193* (2013.01); *B66B 9/16* (2013.01)

(58) Field of Classification Search
CPC ..... B66B 9/16; B66B 9/193
See application file for complete search history.

(56) References Cited

U.S. PATENT DOCUMENTS 2,207,053 A * 7/1940 Fivecoate ..... B66B 9/16 177/139
2,989,140 A * 6/1961 Hill ..... B66F 11/04 182/148
3,178,048 A * 4/1965 Bergman ..... B66B 9/16 182/103
3,891,062 A * 6/1975 Geneste ..... B66B 9/16 182/103
4,018,306 A * 4/1977 Lyons ..... A62B 1/00 104/173.1
4,073,382 A * 2/1978 Fahey ..... B65G 1/026 187/239
4,183,423 A * 1/1980 Lewis ..... B66B 9/16 182/103
4,235,305 A * 11/1980 Nygren ..... E04G 3/24 182/148
4,264,252 A * 4/1981 Jennings ..... A01D 87/127 294/105
4,546,854 A * 10/1985 Bocker ..... B66B 9/16 182/103
5,927,440 A * 7/1999 Freeman ..... B66B 9/16 182/141
6,533,070 B1 * 3/2003 Elrod ..... E06C 1/345 182/103

* cited by examiner

*Primary Examiner* — Minh Truong
(74) *Attorney, Agent, or Firm* — Dunlap Bennett & Ludwig PLLC

(57) ABSTRACT

A portable lift is provided. The portable lift includes a top frame assembly, a carriage frame, a base frame, and a hoist mechanism. The top frame assembly is secures top ends of a pair of stringers together. The base frame assembly secures bottom ends of the pair of stringers together forming the portable lift frame. The carriage frame includes a plurality of wheel assemblies each having a plurality of wheels. The plurality of wheels releasably retain to and slidably engage with a stringer of the pair of stringers. The hoist mechanism includes a motor, a spool rotatable by the motor, a pulley secured to the top frame assembly, and a hoist cable wrapped around the spool and running from the spool through the pulley and secured to the carriage frame.

7 Claims, 5 Drawing Sheets

PORTABLE LIFT

BACKGROUND OF THE INVENTION

The present invention relates to a lift and, more particularly, to a portable lift for hoisting materials at a construction site.

Hoisting materials such as trusses, roofing, block sheathing and the like up to higher building levels is dangerous and exhausting by hand. Current machine lifts require proprietary frame sections that are costly, hard to transport, hard to store and cannot be cut to needed lengths. Further, current machines are heavier, and difficult to transport and set up.

As can be seen, there is a need for an improved lift machine for hoisting materials at a construction site.

SUMMARY OF THE INVENTION

In one aspect of the present invention, a portable lift comprises: a top frame assembly operable to secure top ends of a pair of stringers together; a base frame assembly operable to secure bottom ends of a pair of stringers together; a carriage frame comprising a plurality of wheel assemblies each comprising a plurality of wheels operable to releasably retain to and slidably engage with a stringer of the pair of stringers; and a hoist mechanism comprising: a motor; a spool rotatable by the motor; a pulley secured to the top frame assembly; and a hoist cable wrapped around the spool and running from the spool through the pulley and secured to the carriage frame.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a portable material lift for lifting construction materials to upper levels. The present invention utilizes three portable frame sections and site built rail stringers. The present invention further uses an integrated electric hoist to raise the carriage frame and materials secured on it to upper work areas. The machine of the present invention allows for any length rail stringers for the hoisting allowing a perfect match to height needs that does not exist with other machines.

Figure 1:
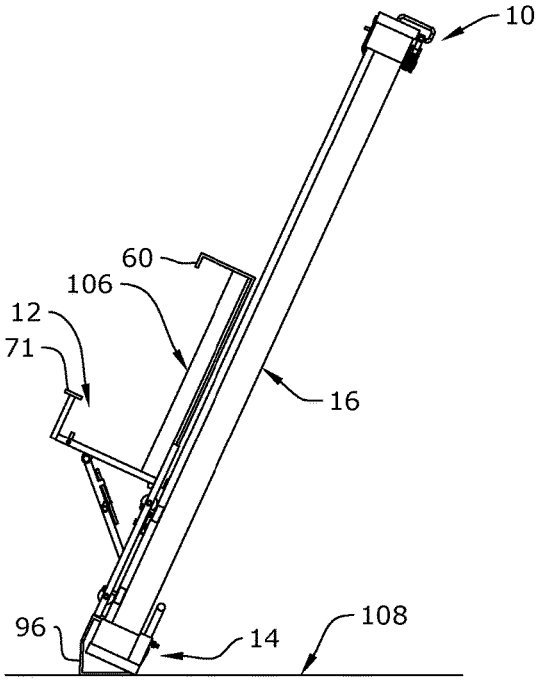
FIG. 1 is a side view of an embodiment of the present invention shown in use in an exemplary initial configuration.
Figure 2:
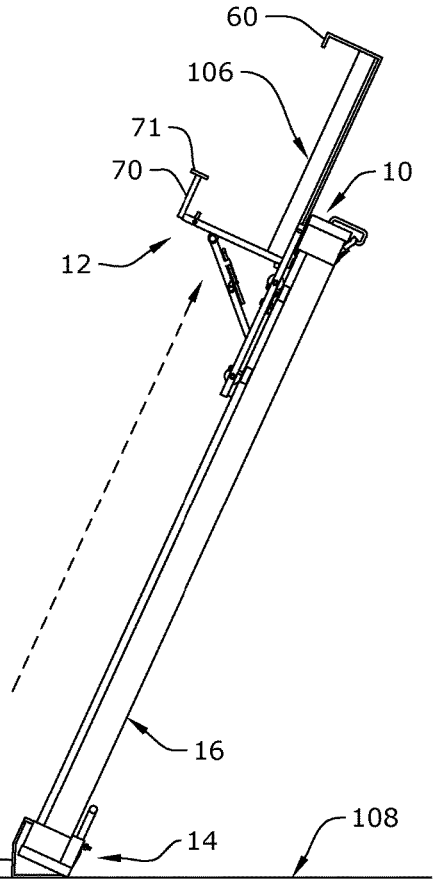
FIG. 2 is a side view of an embodiment of the present invention shown in use in an exemplary secondary configuration.
Figure 3:
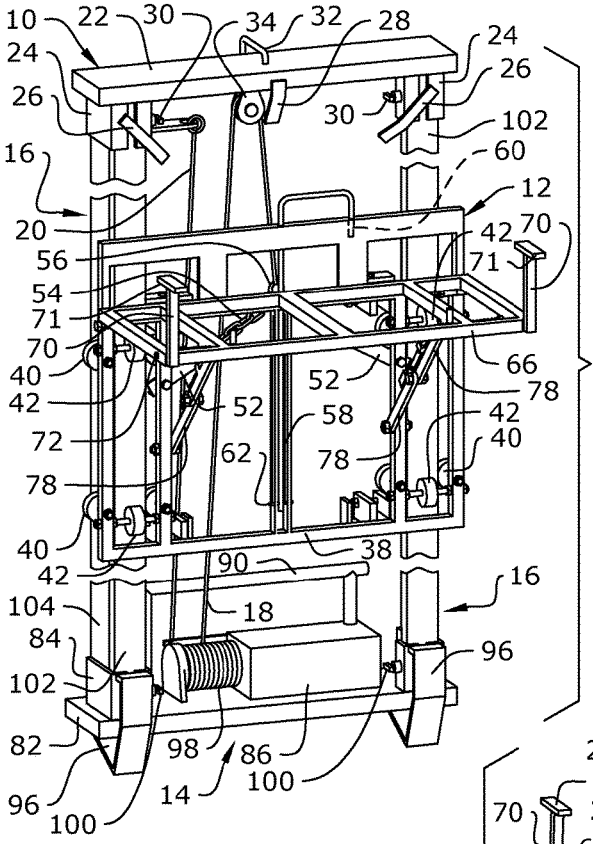
FIG. 3 is a front perspective view of an embodiment of the present invention.
Figure 4:
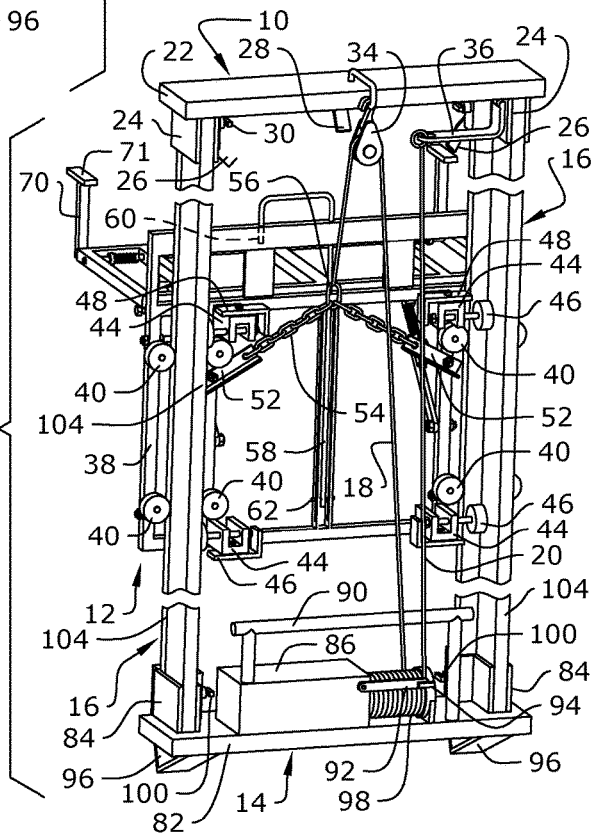
FIG. 4 is a rear perspective view of an embodiment of the present invention.
Figure 5:
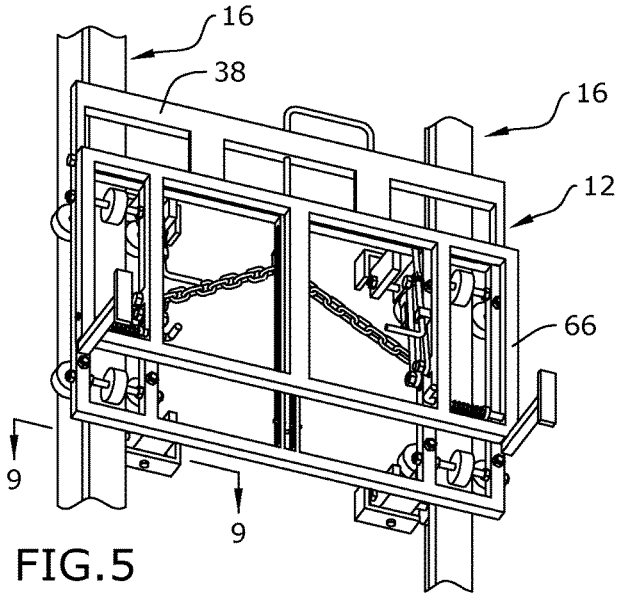
FIG. 5 is a front perspective detail view of an embodiment of the present invention shown in an exemplary initial configuration.
Figure 7:
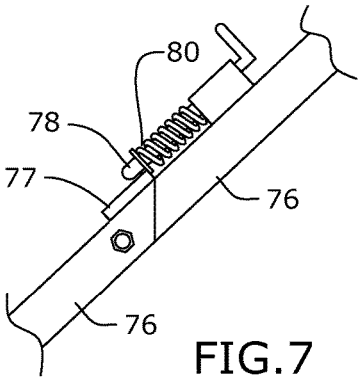
FIG. 7 is a side detail view of an embodiment of the present invention shown in an exemplary initial configuration.
Figure 6:
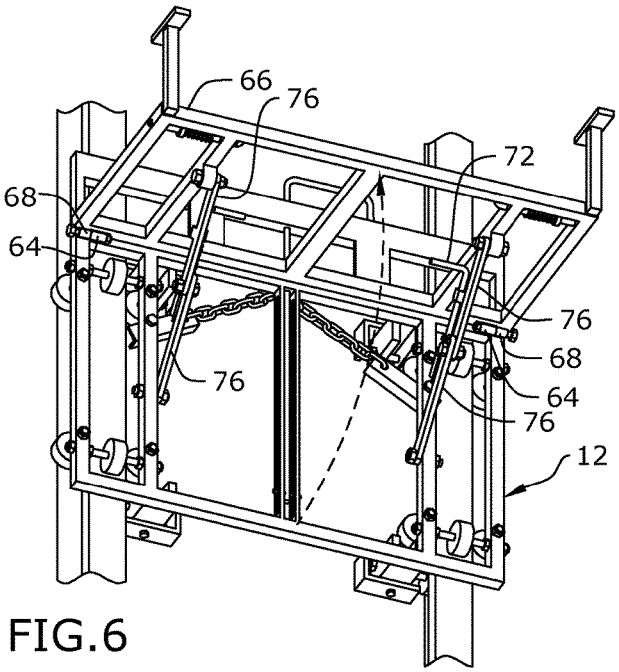
FIG. 6 is a front perspective detail view of an embodiment of the present invention shown in a secondary configuration.
Figure 8:
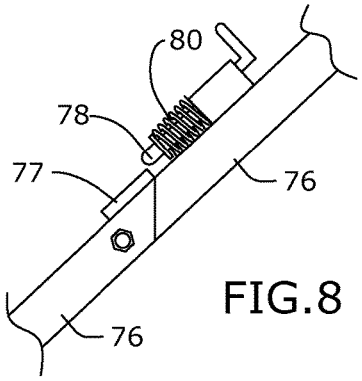
FIG. 8 is a side detail view of an embodiment of the present invention shown in an exemplary secondary configuration.
Figure 9:
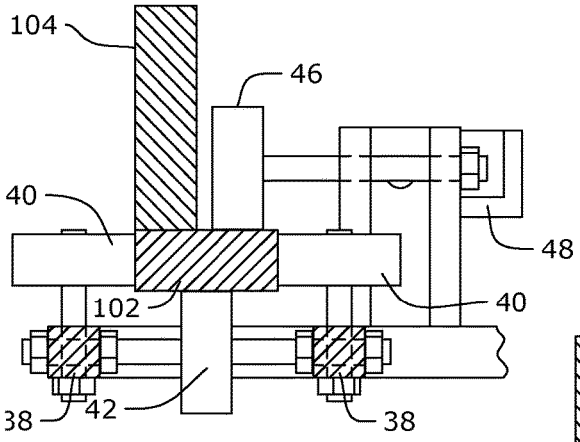
FIG. 9 is a section detail view taken along line 9-9 in FIG. 5 shown in an exemplary initial configuration.
Figure 10:
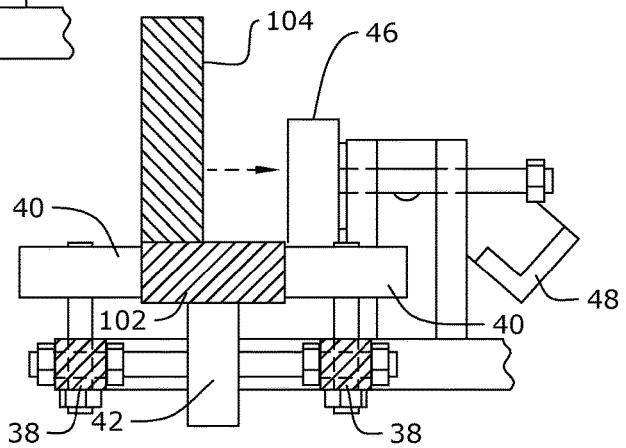
FIG. 10 is the section detail view of FIG. 9 shown in an exemplary secondary configuration.
Figure 11:
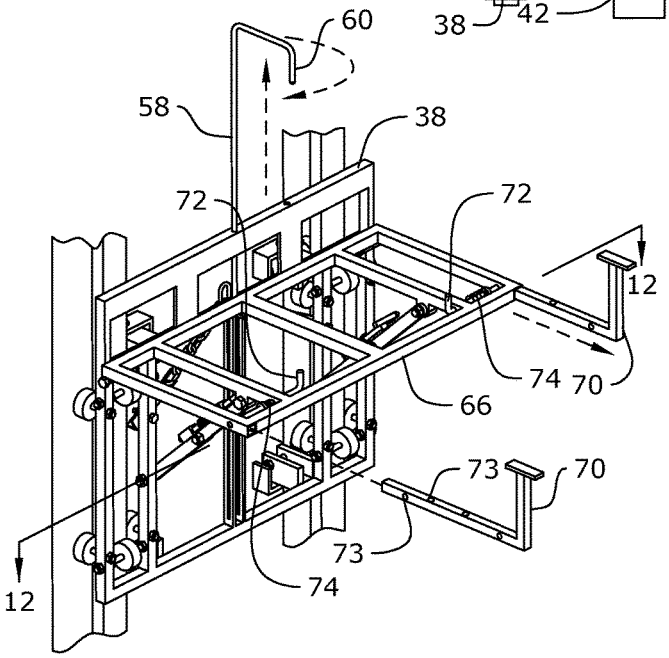
FIG. 11 is a perspective exploded detail view of the present invention demonstrating multiple states.
Figure 12:
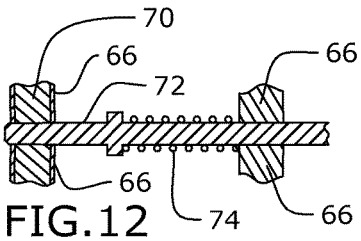
FIG. 12 is a section detail view of an embodiment of the present invention along line 12-12 in FIG. 11 shown in exemplary initial state.
Figure 13:
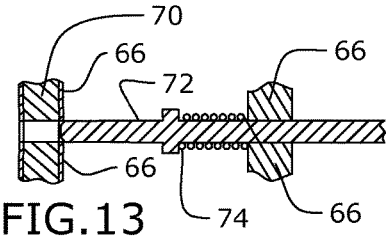
FIG. 13 is the section detail view of FIG. 12 shown in an exemplary secondary state.
Figure 14:
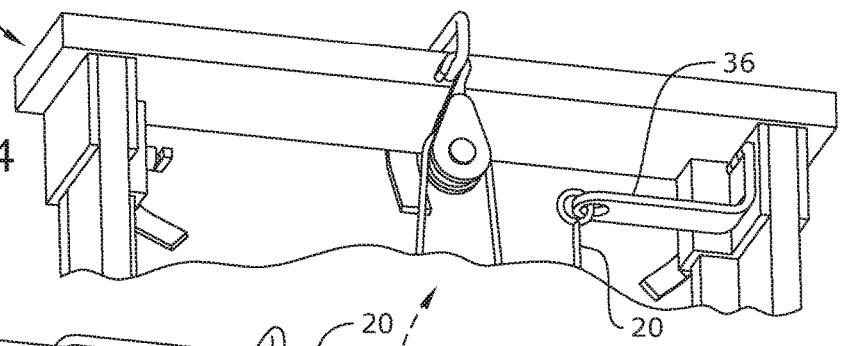
FIG. 14 is a perspective detail view of an embodiment of the present invention shown in an exemplary initial state.
Figure 15:
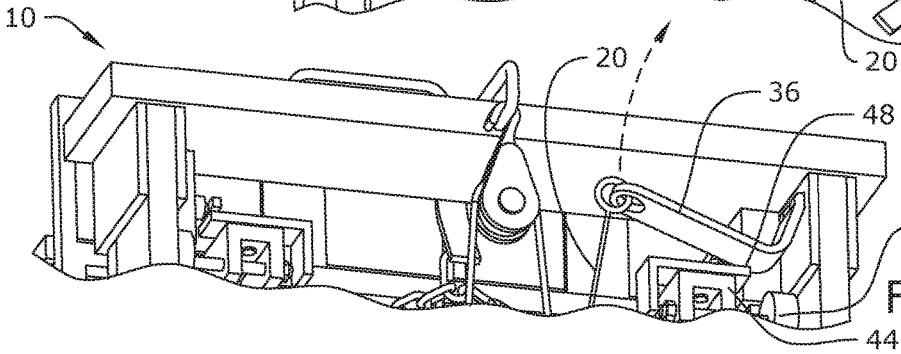
FIG. 15 is a perspective detail view of an embodiment of the present invention shown in an exemplary secondary state.
Figure 16:
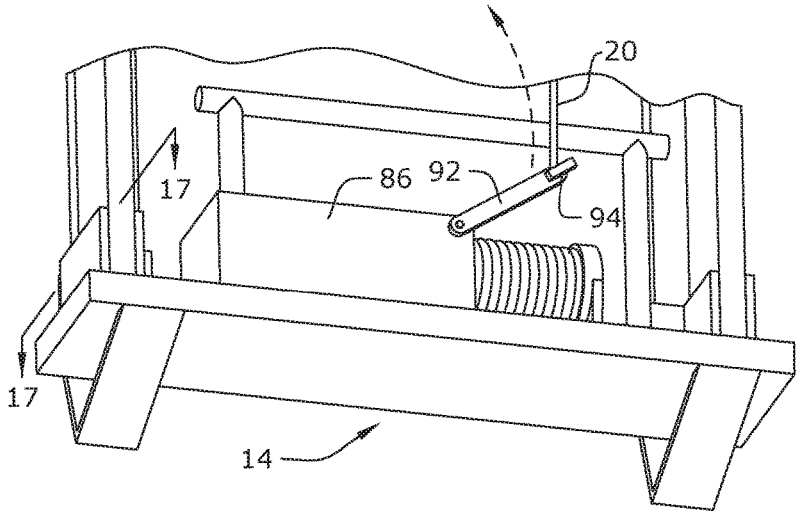
FIG. 16 is a perspective detail view of an embodiment of the present invention shown in an exemplary secondary state.
Figure 17:
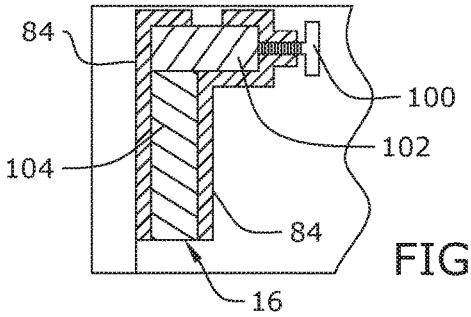
FIG. 17 is a section detail view of the present invention along line 17-17 in FIG. 16.

Referring to FIGS. 1 through 17, the present invention includes a portable lift. The portable lift includes a top frame assembly 10, a carriage frame 12, a base frame 14, and a hoist mechanism. The top frame assembly 10 secures top ends of a pair of stringers 16 together. The base frame assembly 14 secures bottom ends of the pair of stringers 16 together forming the portable lift frame. The carriage frame 12 includes a plurality of wheel assemblies each having a plurality of wheels 40, 42, 46. The plurality of wheels 40, 42, 46 releasably retain to and slidably engage with a stringer 16 of the pair of stringers 16. The hoist mechanism includes a motor 86, a spool 98 rotatable by the motor 86, a pulley 34 secured to the top frame assembly 10, and a hoist cable 18 wrapped around the spool 98 and running from the spool 98 through the pulley 34 and secured to the carriage frame 12.

The stringers 16 of the present invention may be cut from wood at a construction site. The stringers 16 may be formed of a first upright vertical post and a second upright vertical post having top ends and bottom ends. Each post may include a front beam 102 attached to a support beam 104 substantially perpendicular to the front beam 102. In certain embodiments, the wheel assemblies may each include four wheels. Each wheel may slidably engage with a different side of the front beam 102.

The top frame assembly 10 of the present invention may include a main beam 22. The main beam 22 may include a first end and a second end. A first stringer receiver 24 may extend from the first end and a second stringer receiver 24 may extend from the second end. Each stringer receiver 24 is sized to receive a top end of a stringer 16. A thumb screw 30 may run through the stringer receiver 24. When the top end of the stringer 16 is within the stringer receiver 24, the thumb screw 30 may be tightened to retain the top end within the stringer receiver 24. The top frame assembly 10 may further include deflector plates 26, 28. A top deflector plate 28 may be secured to the main beam 22 and side deflector plates 28 may be secured to the first stringer receiver 24 and the second stringer receiver 24. The deflector plates 26, 28 may guide the carriage frame 12 into the top frame assembly 10.

The base frame assembly 14 may include a main beam 82 having a first end, a second end, a top surface and a bottom surface. A first stringer receiver 84 may extend from the first end and a second stringer receiver 84 may extend from the second end. Each stringer receiver 84 is sized to receive a bottom end of a stringer 16. A thumb screw 100 may run through the stringer receiver 84. When the bottom end of the stringer 16 is within the stringer receiver 84, the thumb screw 100 may be tightened to retain the bottom end within the stringer receiver 24. In certain embodiments, angled pads 96 may be secured to the bottom surface of the base frame assembly 14. The angled pads 96 provide additional support when the stringers 16 are leaned against a scaffold or building. The base frame assembly 14 may further include a carry tube 90. The hoist cable 18 may be wrapped around the carry tube 90 when the portable lift is disassembled. The carry tube 90 may also be used as a handle to carry the base frame assembly 14.

The carriage frame 12 of the present invention may include a back frame 38 and a platform frame 66. The wheel assemblies may be secured to the back frame 38. The back frame 38 may be formed of vertical uprights connected together by cross members. The back frame 38 may further include a top end, a bottom end, a first side, a second side, a front side and a rear side. In certain embodiments, mounting brackets 52 may be secured to the first side and second side of the rear side of the back frame 38. Chains 54 may run from the mounting brackets and attach to a link 56. The hoist cable 18 may attach to the link 56, thereby securely attaching the carriage frame 12 to the hoist mechanism.

The back frame 38 may further include a retaining hook 58, 60. The retaining hook 58, 60 may include a shaft 58 and a hook 60. The shaft 58 may slidably engage with a guide channel 62 formed in the back frame 38. The hook 60 may protrude from the top end of the back frame 38. The retaining hook 58, 60 may be in an expanded form and a retracted form. The expanded form includes the retaining hook 58, 60 sliding upwards and away from the top end. The hook 60 may be rotated and used to retain materials 106 during transport within the carriage frame 12. The retracted form may include the shaft 58 substantially within the guide channel 62 while the portable lift is disassembled.

A wheel frame assembly may be located at the top first side, the top second side, the bottom first side, and the bottom second side of the back frame 38. The wheel frame assemblies may each include a front wheel 42, a first side wheel 40, a second side wheel 40, and a rear wheel 46. The front wheel 42 may be rotatable about a front wheel axle disposed in between the vertical posts of the back frame 14. The first side wheel 40 and a second side wheel 40 are each rotatable about a side wheel axle protruding from the rear side of the back frame 38. The side wheel axles may be substantially perpendicular to the front wheel axle. The front wheel 42 is disposed in between the first side wheel 40 and the second side wheel 40. The wheel assembly may further include a wheel bracket 44 protruding from the rear side of the back frame 38. A rear wheel axle is slidably engaged with the wheel bracket 44 and slides along an axis parallel to the front wheel axle. The wheel frame assembly includes an engaged position and a disengaged position. The engaged position includes the rear wheel axle sliding away from the wheel bracket 44 towards the front wheel 42 and the disengaged position includes the rear wheel axle sliding away from the front wheel 42 and towards the wheel bracket 44. The wheel frame assembly may further include a locking mechanism. The locking mechanism may include a locking bracket 48. The locking bracket 48 is spring biased to block the rear wheel axle from sliding. The locking bracket 48 locks the wheel frame assembly in the engaged position.

As mentioned above, the carriage frame 12 includes a platform frame 66. The platform frame 66 may be pivotally connected to the back frame 38. For example, the platform frame 66 may include a hinge pin sleeve 68 that aligns with a hinge pin sleeve 64 on the carriage frame 12. A hinge pin may fit through the hinge pin sleeves 64, 68 pivotally connecting the platform frame 66 to the back frame 68. The platform frame 66 may include an expanded position where the platform frame 66 is pivoted away from the back frame 38 and substantially perpendicular with the back frame 38 and a retracted position including the platform frame 66 pivoted towards the back frame 38.

In certain embodiments, lever arms 76 may pivotally connect the bottom end of the platform frame 66 and the back frame 38. The lever arms 76 may each include a top arm and a bottom arm pivotally connected together at a connection point. The top arm may also be pivotally connected to the platform frame 66 and the bottom arm pivotally connected to the back frame 38. A locking mechanism may be used to prevent the top arm and bottom arm from pivoting relative to one another. The locking mechanism may include a lock plate 77 secured to the bottom arm. A lock pin 78 may be secured to the top arm and may be spring biased towards the lock plate 77 by a spring 80. In a locked position, the lock pin 78 may be biased against the lock plate by the spring 80. To pivot the lever arms 76, the lock pin 78 may be pulled against the spring bias allowing the top arm and bottom arm to pivot relative to one another.

In certain embodiments, retaining rails 70 may fit within slots formed in the platform frame 66. The retaining rails 70 may include end plates 71 to aid in securing the materials 106 within the carriage frame 12. The retaining rails 70 may further include openings 73 that align with openings formed within the slots. A locking mechanism may be used to secure the retaining rails 70 to the platform frame 66. A lock pin 72 may run through the aligned openings 73 of the retaining rails 70 and the platform frame 66. A spring 74 may bias the pin 72 within the aligned openings 73, thereby securing the retaining rails 70 within the slots. Each retaining rail 70 may include a plurality of openings 73 to adjust the length of the retaining rail 70 relative to the platform frame 66.

As mentioned above, the hoist mechanism may include a motor 86, a spool 98, a pulley 34 and a hoist cable 18. In certain embodiments, the motor 86 may be secured to the base frame 14. The motor 86 may be an electric or gas hoist motor. The pulley 34 may be secured to a hook 32 mounted on the top frame assembly 10. The hoist mechanism may include a shut off mechanism. The shut off mechanism may include a lever arm 36 pivotally secured to the top frame assembly 10. For example, the lever arm 36 may be pivotally secured to one of the stringer receivers 24. The motor 86 may include a switch 92. A safety cable 20 may secured to the switch 92 by a thumb screw 94. The safety cable 20 may run from the switch 92 and attach to the lever arm 36. When the carriage frame 12 hits the lever arm 36, the lever arm 36 is pivoted upwards which in turn pivots the switch 92 upward. Once the switch 92 is pivoted upward the motor 86 turns off.

Assembling the present invention may include the following. A pair of stringers 16 may be cut to size and assembled. A top end of a first stringer 16 is inserted into the first stringer receiver 24 of the top frame assembly 10. A top end of a second stringer 16 is inserted into the second stringer receiver 24 of the top frame assembly 10. A bottom end of the first stringer 16 is inserted into the first stringer receiver 84 of the bottom frame assembly 14. A bottom end of the second stringer 16 is inserted into the second stringer receiver 84 of the bottom frame assembly 14. The thumb screws 30 of the top frame stringer receivers 10 and the thumb screws 100 of the bottom stringer receivers 84 may be tightened to secure the top and bottom ends within their respective stringer receivers 30, 100.

The carriage frame 12 may be secured to the pair of stringers 16 in between the top frame assembly 10 and the bottom frame assembly 14. The wheel assemblies at the top first side and the bottom first side may be secured to the first stringer 16 and the wheel assemblies at the top second side and the bottom second side may be secured to the second stringer 16. The rear wheel of each of the wheel assemblies may slide away from the front wheel into the disengaged position. The front wheel and the side wheels may be placed against the stringer 16 and the rear wheel may slide towards the stringer 16 to engage the back of the stringer. The locking bracket 48 may spring bias behind the rear wheel axel, preventing the rear wheel axle from sliding back to being disengaged. The wheel assemblies are now slidably secured to the stringers 16.

In use, the stringers 16 may be leaned against a scaffold or building. The angled pads 96 may support the stringers 16 at an angle relative to the surface 108 in which the stringers 16 are resting. The platform frame 66 and the retaining hook 58, 60 may be locked in the expanded form. Materials 106 may loaded onto the carriage frame 12. The motor 86 may be turned on, which rotates the spool 98 and ravels the hoist cable 18 around the spool 98. Since the hoist cable 18 is secured to the carriage frame 12, the hoist cable 18 pulls the carriage frame up the stringers 16. Once the carriage frame 12 hits the lever arm 38, the motor 86 is powered off. The materials 106 may be unloaded from the carriage frame 12 at an elevated position either in a scaffold or building.

It should be understood, of course, that the foregoing relates to exemplary embodiments of the invention and that modifications may be made without departing from the spirit and scope of the invention as set forth in the following claims.

What is claimed is:

1. A portable lift comprising:

a top frame assembly operable to secure top ends of a pair of stringers together;

a base frame assembly operable to secure bottom ends of the pair of stringers together;

a carriage frame comprising a back frame, a platform frame, and a plurality of wheel assemblies secured to the back frame, wherein each of the plurality of wheel assemblies comprise:

a front wheel rotatable about a front wheel axle disposed in between vertical posts of the back frame;

a first side wheel and a second side wheel each rotatable about a side wheel axle protruding from a rear side of the back frame and substantially perpendicular to the front wheel axle, wherein the front wheel is disposed in between the first side wheel and the second side wheel;

a wheel bracket protruding from the rear side of the back frame;

a rear wheel axle slidably engaged with the wheel bracket;

a rear wheel rotatable about the rear wheel axle; and a locking mechanism, wherein the wheel assembly comprises an engaged position comprising the rear wheel axle sliding away from the wheel bracket towards the front wheel and a disengaged position comprising the rear wheel axle sliding away from the front wheel and towards the wheel bracket, wherein the locking mechanism is spring biased to lock the rear wheel axle in the engaged position, preventing the rear wheel axle from sliding; and a hoist mechanism comprising:

a motor;

a spool rotatable by the motor;

a pulley secured to the top frame assembly; and a hoist cable wrapped around the spool and running from the spool through the pulley and secured to the carriage frame.

2. The portable lift of claim 1, further comprising a retaining hook protruding from a top end of the back frame.

3. The portable lift of claim 1, wherein the platform frame is pivotally attached to the back frame.

4. The portable lift of claim 3, wherein the platform frame comprises an expanded position comprising the platform frame pivoted away from the back frame and substantially perpendicular with the back frame, and a retracted position comprising the platform pivoted towards the back frame.

5. The portable lift of claim 1, wherein the motor is secured to the base frame assembly.

6. The portable lift of claim 1, further comprising at least one angled foot secured to a bottom side of the base frame.

7. The portable lift of claim 1, further comprising a safety stop mechanism comprising:

a lever arm pivotally attached to the top frame assembly;

a switch operatively connected to the motor; and a safety cable attaching the lever arm and the switch together.

* * * * *